US009666010B2

(12) United States Patent
Geesmeier

(10) Patent No.: US 9,666,010 B2
(45) Date of Patent: May 30, 2017

(54) CASH BOX HAVING AN ADJUSTABLE BELT SUPPORT

(71) Applicant: WINCOR NIXDORF INTERNATIONAL GMBH, Paderborn (DE)

(72) Inventor: Andreas Geesmeier, Bad Wuennenberg (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 14/628,614

(22) Filed: Feb. 23, 2015

(65) Prior Publication Data

US 2015/0248803 A1 Sep. 3, 2015

(30) Foreign Application Priority Data

Feb. 28, 2014 (EP) ..... 14157247

(51) Int. Cl.
*G07F 7/04* (2006.01)
*G07D 11/00* (2006.01)

(52) U.S. Cl.
CPC ..... *G07D 11/0012* (2013.01); *G07D 11/0003* (2013.01); *G07D 11/0006* (2013.01); *G07D 11/0021* (2013.01)

(58) Field of Classification Search
CPC ..... G07D 11/0003; G07D 11/0006; G07D 11/0009; G07D 11/0012; G07D 11/0015; G07F 19/20; G07F 19/201; G07F 19/202; B65G 23/44; B65H 2701/1912; B65H 1/022; B65H 1/025; B65H 1/22; Y10S 902/08; Y10S 902/14
USPC ..... 194/206, 207; 235/379; 209/534; 902/13; 198/813–816; 271/149–151
See application file for complete search history.

(56) References Cited

U.S. PATENT DOCUMENTS

| | | | | |
|---|---|---|---|---|
| 7,946,774 | B2 | 5/2011 | Matias | |
| 8,567,773 | B2 | 10/2013 | Berendes | |
| 2004/0178564 | A1* | 9/2004 | Graef | B65H 5/025 271/162 |
| 2009/0152805 | A1* | 6/2009 | Nomiyama | B65H 1/025 271/227 |
| 2010/0218707 | A1* | 9/2010 | Billet | G07D 11/0012 109/53 |
| 2012/0032391 | A1* | 2/2012 | Holland-Letz | G07D 11/0012 271/303 |

FOREIGN PATENT DOCUMENTS

| | | |
|---|---|---|
| DE | 10 2008 018 975 | 10/2008 |
| DE | 10 2009 058 519 | 6/2011 |

OTHER PUBLICATIONS

European Search Report of Aug. 4, 2014.

* cited by examiner

*Primary Examiner* — Jeffrey Shapiro
(74) *Attorney, Agent, or Firm* — Gerald E. Hespos; Michael J. Porco; Matthew T. Hespos

(57) ABSTRACT

A cash box (10) has a holding area (24) bordered by a bottom unit (26) for holding a stack of currency bills. The bottom unit (26) has at least one belt (28, 30), on which the currency bills accommodated in the holding area (24) stand on their edges. Furthermore, at least one belt support (50, 52) is adjustable between a first position and a second position. The belt support (50, 52) in the second position raises the belt (28, 30) in the direction of the holding area (24) relative to the first position.

17 Claims, 3 Drawing Sheets

CASH BOX HAVING AN ADJUSTABLE BELT SUPPORT

BACKGROUND

1. Field of the Invention

The invention relates to a cash box having a holding area for holding a stack of currency as well as an opening for machine feed to and/or withdrawal of currency bills from the holding area, respectively. The opening is closable by a closure unit. Furthermore, the cash box has a bottom unit that borders the holding area in the direction of the bottom of the cash box. This bottom unit comprises at least one belt on which the currency bills accommodated in the holding area stand on their edges.

2. Description of the Related Art

Known cash boxes have a first opening, through which the currency bills can be fed and withdrawn by machine, for example, when the cash box is accommodated in an automatic teller machine. The currency bills accommodated in the cash box are disposed here in the form of a stack with their edges coming in contact with the belts of the bottom unit, and can be moved in the feed direction of the currency bills and opposite the feed direction of the currency bills, so that the currency bills can be moved within the holding area by means of the frictional forces prevailing between the currency bills and the belts.

The known cash boxes also have a second opening that can be closed by a cover, and through which the currency bills can be fed and/or withdrawn manually, for example, in a cash center. In manual feed of currency bills, there is often the problem that individual currency bills protrude slightly out of the stack of other currency bills. When introducing this stack of currency bills into the holding area, it can happen that these protruding currency bills are pulled beneath the other currency bills of the stack of currency bills by means of the belts when the stack of currency bills is shifted over the belts. The currency bills are then not disposed properly within the stack of currency bills, so that problems may occur in a machine count of the currency bills.

Such cash boxes are known from the documents DE 10 2008 018 975 A1 and DE 10 2009 058 519 A1, for example.

The object of the invention is to provide a cash box with which currency bills can be fed reliably by machine and also manually to a holding area.

SUMMARY OF THE INVENTION

According to the invention, the cash box has a belt support that is adjustable between a first position and a second position. The belt support raises the belt in the second position relative to the first position in the direction of the holding area. Thus the belt also is moved, namely raised, between the first and the second positions in adjusting the belt support, so that the belt protrudes farther into the holding area of the cash box. When the belt support is disposed in the second position, greater frictional force prevails between the belt and the currency bills accommodated in the holding area than when the belt support is disposed in the first position.

This achieves the result that the frictional forces prevailing between the belts and the currency bills can be adjusted easily and thus can be adapted to the respective situation. In particular, in situations in which a high frictional force is necessary, for example, in machine counting of currency bills, the belt supports may be disposed in the second position, so that a great frictional force is in effect. Conversely, the belt support is disposed in the first position when a low fictional force between the belts and the currency bills is advantageous, for example, when the currency bills are fed manually.

The bottom unit may have at least two belts that are preferably disposed parallel to one another. In this case, another belt support also is provided, with one belt support being allocated to one belt and serving to raise this belt in that it is moved from a first position into a second position.

By providing a plurality of belts that can be raised above their respective belt support accordingly, secure stacking and a more reliable transport of the currency bills are achieved.

In an alternative embodiment, more than two belts may also be provided.

The belts may be disposed symmetrically with a central axis of the cash box. Accordingly, the belt supports also may be disposed symmetrically.

The two belts and/or the two belt supports may be shaped identically, so that the fewest possible different types of components are required and inexpensive mass production is possible.

The belts may be guided over deflector elements, e.g., rollers or gearwheels. At least one of these deflector elements can be driven by a drive unit, so that the corresponding belt can also be driven by driving the deflector element. Thus, the currency bills accommodated in the holding area can also be moved in the direction of the opening and/or away from the opening within the holding area by the frictional force prevailing between the belt and the currency bills. This achieves reliability when paying in and counting out the currency bills.

The following features, which are described for one belt and one belt support, may also be implemented in particular for the other belt and/or the other belt support and/or the other belts and/or the other belt support and/or the other belt supports.

In machine feed of currency bills, the belt support is disposed above the opening in the second position, so that a great friction prevails between the currency bills and the belt in machine feed accordingly. Thus, bills can be transported reliably away from the opening and further into the holding area. The cash box may have another opening that can be closed by a cover and by means of which the currency bills can be fed manually and/or removed manually. The belt support is disposed above this additional opening, in particular in the first position, in manual feed and/or removal of currency bills through this additional opening, so that in manual feed only a lesser frictional force prevails between the belts and the currency bills. This prevents currency bills that protrude out of a stack of currency bills from being pulled beneath the other bills of the stack of currency bills due to the prevailing frictional forces. This ensures that the currency bills will always be oriented in the proper position and that reliable feed and discharge are possible.

The two openings may be disposed on different sides of the cash box. The opening for the machine feed may be disposed on one end, and the opening for manual feed may be disposed on the top side of the cash box, so that the two openings are disposed with a 90° offset from one another.

An adjusting unit may be provided for moving the belt support from the first position into the second position. This adjusting unit may be a drive unit. Alternatively, the adjustment may also be made by means of the closure unit, as described in greater detail below.

The belt support is prestressed in the first position, such as by an elastic element, and is moved from the first position into the second position by the adjusting unit opposite a restoring force of this elastic element. The belt support then is moved from the second position back into the first position because of the restoring force of the elastic element, so that the adjusting unit must make an adjustment in only one direction.

The elastic unit may be a spring. Alternatively or additionally, the elastic unit may be the belt itself, which is designed to be elastic accordingly and is deformed accordingly when the belt support is lifted, i.e., an adjustment of the belt support from the first position into the second position, so that a restoring force is exerted on the belt support.

Alternatively, the belt support may be moved back from the second position into the first position by the force of gravity as soon as it is no longer being held in the second position by the adjusting unit.

The belt may be disposed in parallel with the bottom of the cash box when the belt support is disposed in the first position. In particular the surface of the belt on which the currency bills stand on their edges is disposed parallel to the bottom of the cash box. If the belt is raised by the belt support, then the plane defined by its surface is no longer parallel to the bottom of the cash box. In particular the belt arches upward accordingly at the location where the belt support is disposed.

The belt support may contact the belt in both the first position and the second position. Thus, the belt also is guided in the first position by the belt support. In an alternative embodiment, the belt support may contact the belt only in the second position, and in the first position it is disposed at a predetermined distance from the belt.

The belt support may be designed so that a frictional force prevailing between the belt support and the belt is as low as possible, so that, even when the belt is raised above the belt support, the belt can still be moved easily.

The closure unit may comprise in a plurality of elements connected to one another in an articulated manner. These elements may be shaped so that a sliding door type of construction of the closure element is achieved, so that it has the most possible articulations and can be moved easily from the open position into the closed position.

The closure unit may be disposed in a closed position so that it closes the opening, and in an open position so that it does not close the opening. The belt support then is in the second position when the closure unit is in the open position and is in the first position when the closure unit is in the closed position.

Machine feed or withdrawal of currency bills always takes place only when the closure unit is in the open position, i.e., whenever the belt support is in the second position. However, if the closure unit is in the closed position, then there is also no machine feed or withdrawal of currency bills, so the belt support need not be in the second position, but instead may be in the first position, so it is possible to ensure that the belt support is still disposed in the first position, even in the event of a possible feed and/or withdrawal of currency notes above the additional opening, and thus the least possible frictional force is in effect.

The closure unit may move automatically from the first position into the second position when moving from the closed position into the open position. This achieves the result that no separate adjusting unit is needed for adjusting the belt support, in particular no drive unit is needed but instead the adjustment takes place automatically by means of the closure unit. Thus only minimal structural changes are necessary on the cash box and the existing cash box mechanism can be used. This also has the advantage that the adjustment of the belt support cannot be forgotten, and it ensures that the belt support will in fact always be disposed in the second position whenever the closure unit is in the open position, i.e., when currency bills might be fed and withdrawn by machine.

The movement of the belt support from the second position back to the first position takes place automatically in particular due to the force of gravity of the belt support and/or restoring forces of elastic elements when the closure element is moved from the open position to the closed position and therefore no longer holds the belt support in the second position. Alternatively, the movement of the belt support from the second position back into the first position may also take place actively by means of the closure unit.

The closure unit may have at least one, preferably at least two, protrusions by means of which the belt support is lifted into the second position when the closure unit in the open position. The protrusions are designed in the form of a ramp in particular, i.e., they have chamfered side flanks, so that when the closure unit is moved from the closed position into the open position, the belt support runs slowly, in particular continuously, onto the ramp-shaped protrusions and is thus raised. The belt support also may have protrusions, that contact the protrusions on the closure unit when the closure unit is disposed in the open position.

In the embodiment having a plurality of belt supports for multiple belts, at least one, preferably two protrusions, are provided for each belt support, and each protrusion may be designed in the form of a ramp.

In the open position, the closure element is accommodated preferably at least partially, in particular completely, in a gap between the bottom unit and the bottom of the cash box, so that the closure unit can be accommodated in a space-saving manner and there is no contact with the currency bills, so that interference is prevented.

The bottom unit may have a cover element that demarcates the gap from the holding area. Recesses may be provided in this bottom unit, through which the belt support protrudes at least partially within the gap situated beneath the bottom unit, so that contact with the closure unit is possible for adjusting the belt support from the first position into the second position.

Additional features and advantages of the invention are derived from the following description, which explains the invention in greater detail on the basis of exemplary embodiments in conjunction with the accompanying figures.

DETAILED DESCRIPTION

Figure 1:
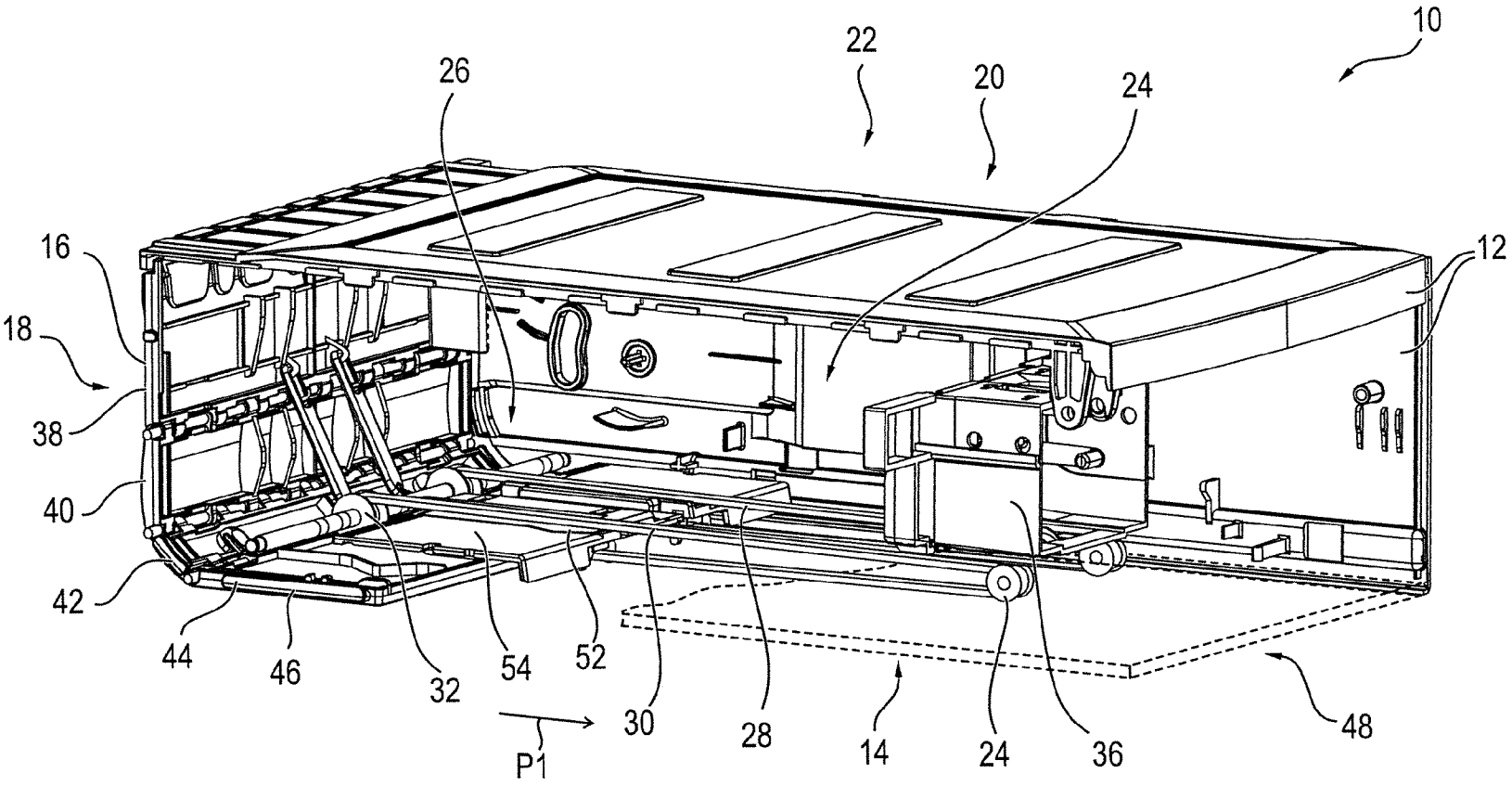
FIG. 1 is a schematic, perspective diagram of the cash box.

FIG. 1 shows a schematic, perspective diagram of a cash box 10. The cash box 10 has a housing 12, comprising a bottom of the cash box 14 that is disposed horizontally when the cash box is oriented as planned, i.e., in the orientation of the cash box 10, when the cash box is accommodated in a device for handling currency bills, for example, an automatic teller machine.

Furthermore, the cash box 10 has a first opening 18 that can be closed over a closure element 16, as well as a second opening 22, which can be closed by means of a cover 20. The first opening 18 serves in particular for machine feed to and/or withdrawal of currency bills from, respectively, a holding area 24 for holding currency bills. The machine feed and/or withdrawal take(s) place in particular by sorting and stacking modules of devices for handling currency bills, for example, in automatic teller machines, automatic checkout machines and/or automatic timer lock boxes.

However, the second opening 22 serves to feed currency bills manually, such as that in a cash center, for example. The currency bills are accommodated in the holding area 24 in the form of a currency bill stack and stand with their edges on belts 28, 30 of a bottom unit 26, which borders the holding area 24 in the direction of the bottom of the cash box 14. The belts 28, 30 are designed as continuous belts, and each is guided over two deflector elements 32, 34, which may be designed as gearwheels, for example. At least one of these deflector elements 32, 34 can be driven by means of a drive unit (not shown), so that the belts 28, 30 can be driven accordingly, so that the currency bills, which are standing with their edges on the belts 28, 30, can be transported away from the first opening 18 and/or toward the first opening 18 by means of a movement of the belts 28, 30 within the holding area 24.

Furthermore, the holding area 24 is bordered by a pressure cart 36 that prestresses the currency bills accommodated in the holding area 24 in the direction of the first opening 18 and thus holds them under the required pressure, so that the currency bills can be removed well and fed well and cannot fall over.

The closure unit 16 comprises a plurality of subareas 38 to 46, each of which is connected to the others in an articulated manner, resulting in a louver-type design on the whole. In FIG. 1, the closure unit 16 is disposed in a closed position, in which it closes the first opening 18. The closure unit 16 can be moved from this closed position into an open position in the direction of the arrow P1, wherein the closure unit 16 does not close the first opening 18 when in the open position, so that currency bills can be fed to and/or removed from the cash box through this opening.

The closure 16 has at least one engagement element, which is not visible in FIG. 1, and in which an engagement element having a complementary design engages when the cash box 10 is inserted into a device for handling of currency bills, for example, an automatic teller machine, so that when the cash box is inserted into a device for handling of currency bills, the closure unit 16 is moved automatically from the closed position into the open position, and the converse is the case when the cash box 10 is moved from the open position into the closed position, so that no separate drive unit is necessary for this and the opening and closing cannot be forgotten. This reduces the susceptibility to errors.

Figure 3:
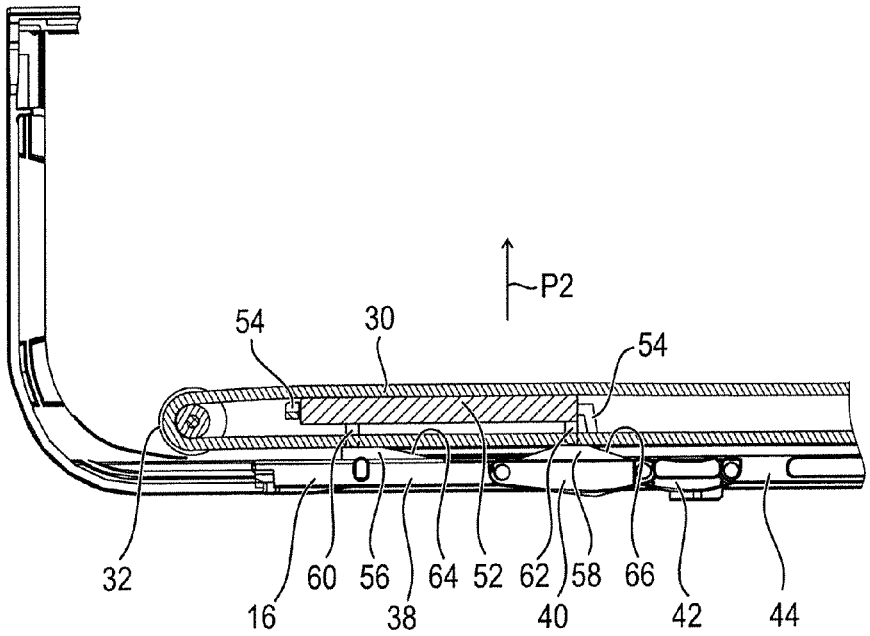
FIG. 3 is another detail of the cash box according to FIG. 1.

The open position of the closure unit 16 is shown in FIG. 3, wherein only a portion of the subareas 38 to 46 is shown here. In particular only the subareas 44, 46 disposed on the front ends of the closure unit 16, as seen in the direction of movement P1 and/or only the front subarea 46, is/are shown.

In machine feed or withdrawal of currency bills through the first opening 18, it is important that a sufficiently high frictional force prevails between the belts 28, 30 and the currency bills, so that the currency belt can be moved reliably into the feed direction and/or the withdrawal direction.

In manual feed of currency bills through the second opening 22, however, a great frictional force is a disadvantage, because in this way currency bills protruding out of the stack of currency bills can be pulled beneath the other currency bills when the bills are guided over the belts 28, 30, so that they are no longer disposed inside the stack and mistakes may occur in counting out the currency bills.

Figure 2:
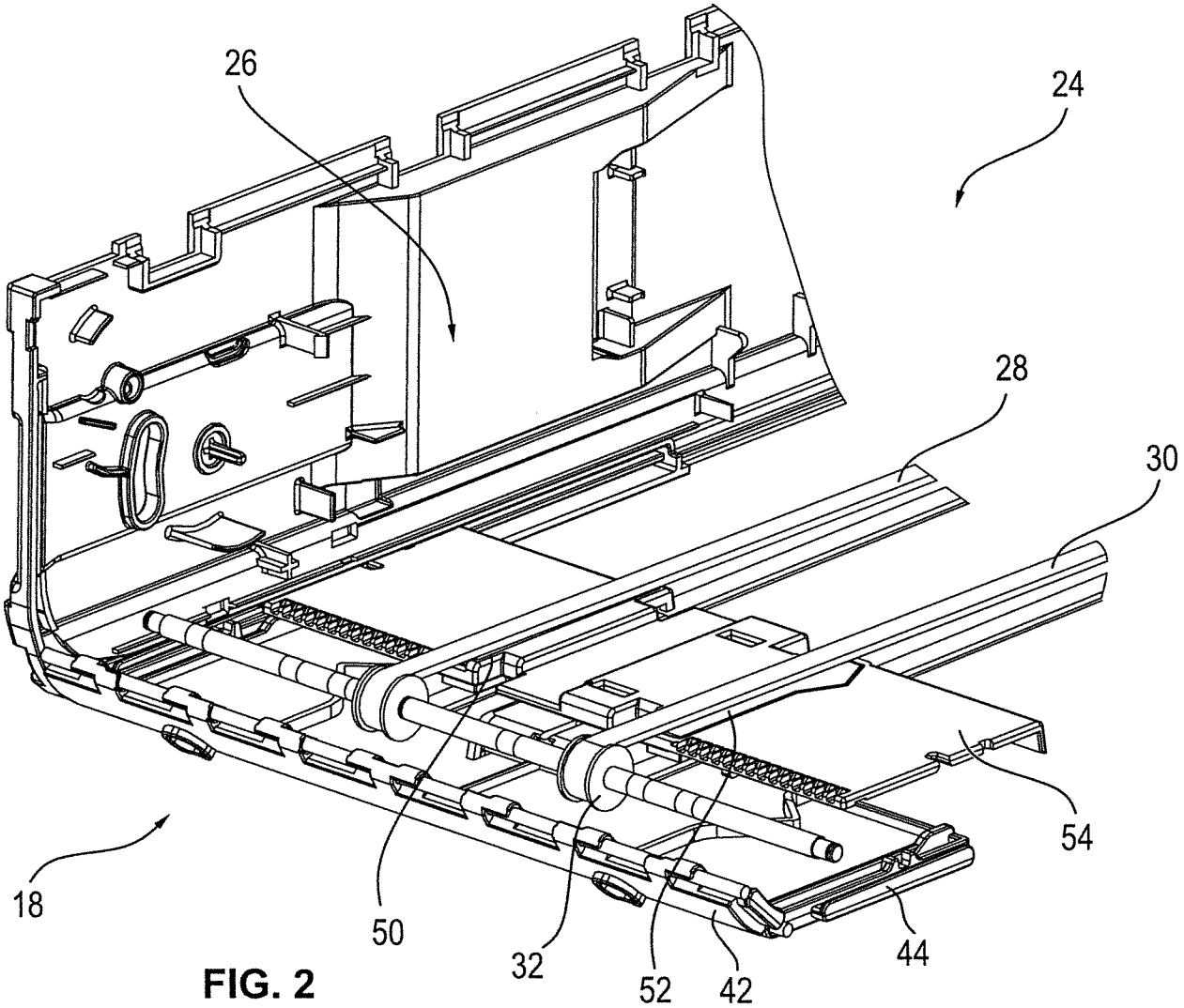
FIG. 2 is a detail of the cash box according to FIG. 1.
Figure 4:
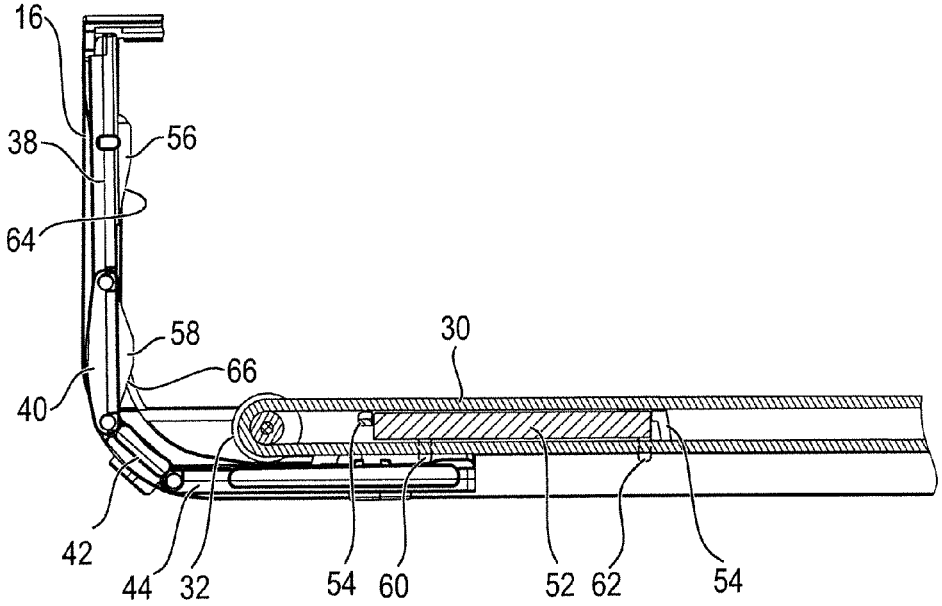
FIG. 4 is another detail of the cash box according to FIG. 1.

To implement a high frictional force and manual feed of a suitably reduced frictional force for the machine feed, the cash box comprises for each belt 28, 30 a belt support 50, 52, which is allocated to the respective belt 28, 30 and is adjustable between a first position, shown in FIGS. 2 and 4, and a second position shown in FIG. 3.

In the first position, the belt supports 50, 52 are disposed in recesses in a bordering element 54 of the bottom unit 26 and do not contact the belts 28, 30. In the second position, however, the belt supports are raised in relation to the first position in the direction of the arrow P2 in the direction of the holding element 24 to such an extent that they also raise the belts 28, 30 in the direction of the holding area 24, i.e., in the direction of the arrow P2 in relation to the position shown in FIGS. 2 and 4. To do so, the belt supports 50, 52 contact in particular the side of the belts 28, 30 opposite the side with which the belts 28, 30 contact the currency bills.

By raising the belts 28, 30 into the second position, this achieves the result that when the belt supports 50, 52 are disposed in the second position, a greater frictional force prevails between the belts 28, 30 and the currency bills accommodated in the holding area 24 than when the belt supports 50, 52 are disposed in the first position.

When the belt supports 50, 52 are disposed in the first position, the belts 28, 30 in particular run in a plane directed parallel to the bordering element 54 and parallel to the bottom of the cash box 14. However, if the belt supports 50, 52 are disposed in a second position, then the belts 28, 30 bulge in the direction of the holding area 24. The plane determined by the surfaces of the belts 28, 30 that contact the currency bills is no longer disposed in parallel with the bottom of the cash box 14.

The belt supports 50, 52 are in particular disposed in the second position when a machine feed and/or withdrawal of currency bills take(s) place through the first opening 18. However, the belt supports 50, 52 are then disposed in the first position when there is a manual feed of currency bills through the second opening 22. This achieves the result that in machine feed, a much greater frictional force prevails between the belts 28, 30 and the currency bills than in manual feed.

The belts 28, 30 are adjusted from the first position into the second position in particular by means of the closure element 16. To this end, the closure unit 16 has two ramp-shaped protrusions 56, 58 for each belt support 50, 52, so that by means of these ramp-type protrusions, the respective belt support 50, 52 can be raised from the first position into the second position. In moving the closure element 16 from the closed position to the open position, protrusions 60, 62 of the belt supports 50, 52 run onto chamfered regions 64, 66 of the ramp-shaped protrusions 56, 58, so that the belt supports 50, 52 are moved automatically from the first position into the second position when opening the closure unit 16.

This has the advantage that no separate adjusting unit is needed for adjusting the belt supports 50, 52, but this is accomplished automatically instead by means of the opening of the closure unit 16, which is necessary for the machine input or output of currency bills. In addition, it is ensured that the belt supports 50, 52 are always disposed automatically in the second position in machine feed and/or withdrawal of currency bills.

If the closure unit 16 is again moved from the open position into the closed position, the belt supports 50, 52 are preferably moved automatically back into the first position. This movement back can take place through the force of gravity of the belt supports 50, 52 and/or a restoring force of an elastic element. In particular the belts 28, 30 themselves exert a restoring force on the belt supports 50, 52 due to their upward bulge, so that the movement back from the second position into the first position also takes place automatically when closing the closure element 16.

Therefore, no separate adjusting mechanism for the belt supports 50, 52 need be provided, so that only very minor changes need be made in the cash box mechanics in particular.

In an alternative embodiment of the invention, it is also possible to provide only one belt support 50, 52, which is designed to be so wide that it raises both belts 28, 30 when they are moved from the first position into the second position.

LIST OF REFERENCE NUMERALS

10 cash box
12 housing
14 bottom of the cash box
16 closure unit
18, 22 opening
20 cover
24 holding area
26 bottom unit
28, 30 belt
32, 34 deflector element
36 pressure car
38 to 46 subarea
50, 52 belt support
54 bordering element
56, 58 protrusion
60, 62 protrusion
64, 66 side flank
P1, P2 direction

What is claimed is:

1. A cash box, comprising:

a holding area (24) for holding a stack of currency bills, the holding area (24) having an opening (18) for machine feed of the currency bills to the holding area (24) and/or withdrawal of the currency bills from the holding area (24);

a closure element (16) for selectively opening and closing the opening (18) of the holding area (24); and a bottom unit (26) that borders the holding area (24) at a position gravitationally below the holding area (24), the bottom unit (26) having:

at least one belt (28, 30) on which the currency bills accommodated in the holding area (24) stand on their edges, and at least one belt support (50, 52) that is gravitationally below at least part of the at least one belt (28, 30) and that is adjustable between a first position and a second position, wherein the belt support (50, 52) raises the belt (28, 30) in the second position relative to the first position in a gravitationally upward direction (P2) of the holding area (24).

2. The cash box (10) of claim 1, wherein the at least one belt (28, 30) comprises at least two belts (28, 30), and the at least one belt support (50, 52) comprises at least two belt supports (50, 52) disposed for raising the respective belts (28, 30) in the second position relative to the first position in the gravitationally upward direction (P2) of the holding area (24).

3. The cash box (10) of claim 2, wherein the two belts (28, 30) and/or the two belt supports (50, 52) have identical shapes.

4. The cash box (10) of claim 1, wherein the belt (28, 30) is guided over deflector elements (32, 34) at least one of which can be driven.

5. The cash box (10) of claim 1, wherein the belt support (50, 52) is disposed in the second position during the machine feed and/or withdrawal of the currency bills through the opening (18) in the second position.

6. The cash box (10) of claim 1, wherein the cash box (10) has an additional opening (22) that can be closed by a cover (20) for manual feed and/or withdrawal of the currency bills, and the belt support (50, 52) is disposed in the first position during the manual feed and/or withdrawal of the currency bills via the additional opening (22).

7. The cash box (10) of claim 6, wherein the opening (18) and the additional opening (20) are disposed on different sides of the cash box (10) and are offset 90° from one another.

8. The cash box (10) of claim 1, further comprising an adjusting unit (16) for moving the belt support (50, 52) from the first position into the second position.

9. The cash box (10) of claim 1, wherein the belt support (50, 52) is prestressed by an elastic element in the first position and can be moved opposite a restoring force of the elastic element from the first position into the second position.

10. The cash box (10) of claim 1, wherein the cash box (14) has a bottom aligned substantially normal to the gravitationally upward direction (P2), and the belt (28, 30) is parallel to the bottom of the cash box (14) when the belt support (50, 52) is in the first position.

11. The cash box (10) of claim 1, wherein the belt support (50, 52) contacts the belt (28, 30) only in the second position.

12. The cash box (10) of claim 1, wherein the closure element 16) in a closed position closes the opening (18) and in an open position does not close the opening (18), and the belt support (50, 52) is disposed in the second position when the closure unit (16) is disposed in the open position, and is disposed in the first position when the closure unit (16) is disposed in the closed position.

13. The cash box (10) of claim 12, wherein the closure unit (16) moves the belt support (50, 52) automatically from the first position into the second position when the closure unit is moved from the closed position into the open position.

14. The cash box (10) of claim 13, wherein the closure unit (16) has at least one protrusion (56, 58) for raising the belt support (50, 52) from the first position into the second position as the closure unit (16) is moved from the closed position into the open position.

15. The cash box (10) of claim 1, wherein the closure unit (16), when in the open position is accommodated in a gap between the bottom unit (26) and a gravitational bottom of the cash box (14).

16. The cash box (10) of claim 14, wherein the closure unit (16) comprises a plurality of subareas (38-46) connected to one another in an articulated manner, and the at least one protrusion (56, 58) being on at least one of the subareas (38, 40).

17. The cash box (10) of claim 16, wherein the subareas (38-46) move beneath the belt support (50, 52) as the closure unit (16) is moved from the closed position into the open position, the at least one protrusion (56, 58) moving beneath the belt support (50, 52) and raising the belt support (50, 52) from the first position into the second position as the subareas (38, 40) with the at least one protrusion (56, 58) move beneath the belt support (50, 52).

* * * * *